US006511341B1

(12) United States Patent
Finona et al.

(10) Patent No.: US 6,511,341 B1
(45) Date of Patent: Jan. 28, 2003

(54) BREAK-AWAY DEVICE

(75) Inventors: Michael Santos Finona, Fountain Valley, CA (US); James Edward Novacoski, Yucaipa, CA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 09/911,748

(22) Filed: Jul. 23, 2001

(51) Int. Cl.[7] ..... H01R 13/60
(52) U.S. Cl. ..... 439/475; 411/5; 439/905
(58) Field of Search ..... 439/475; 403/2; 411/2, 4, 5; 385/101, 107

(56) References Cited

U.S. PATENT DOCUMENTS 2,083,054 A * 6/1937 Cline ..... 138/32
3,796,125 A * 3/1974 Campbell et al. ..... 411/2
3,899,196 A * 8/1975 Dashner ..... 285/2
4,091,841 A * 5/1978 Beneker et al. ..... 138/89
4,934,950 A * 6/1990 Green et al. ..... 439/362
5,346,406 A * 9/1994 Hoffman et al. ..... 439/474
5,816,758 A * 10/1998 Huber ..... 403/2
5,855,443 A * 1/1999 Faller et al. ..... 248/548
6,146,188 A * 11/2000 Snyder ..... 439/474

* cited by examiner

*Primary Examiner*—Neil Abrams
*Assistant Examiner*—Phuong Dinh
(74) *Attorney, Agent, or Firm*—Roger C. Turner

(57) ABSTRACT

A break-away apparatus for electrical and optical connectors (12) includes front and rear fittings (30, 32) with peripheries that have pairs of aligned fastener-receiving holes, and a plurality of fasteners (100) that each lies in a pair of holes and holds the peripheries of the fittings together. Each fastener is a screw with a shank having a threaded front end that engages threads in the hole of the front fitting, and includes a screw head (214) at the rear of the shank which lies against a rearwardly-facing shoulder (172) on the rear fitting, to thereby prevent fitting separation. A bore (142) extends along the axis of the shank, and a rear end portion of the shank has a groove (182), resulting in a break-away portion of the fastener that has a ring-shaped cross-section. The ring-shaped coss-section permits tightening of the screw but results in the screw breaking when a predetermined force is applied to allow separation of the fittings.

7 Claims, 4 Drawing Sheets

FIG. 5
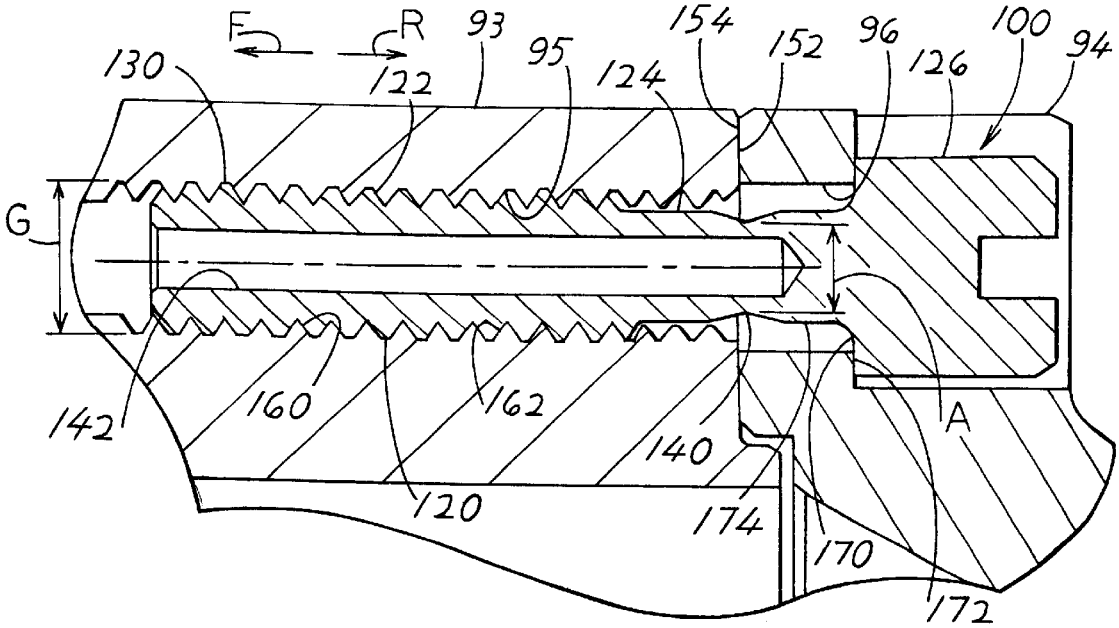
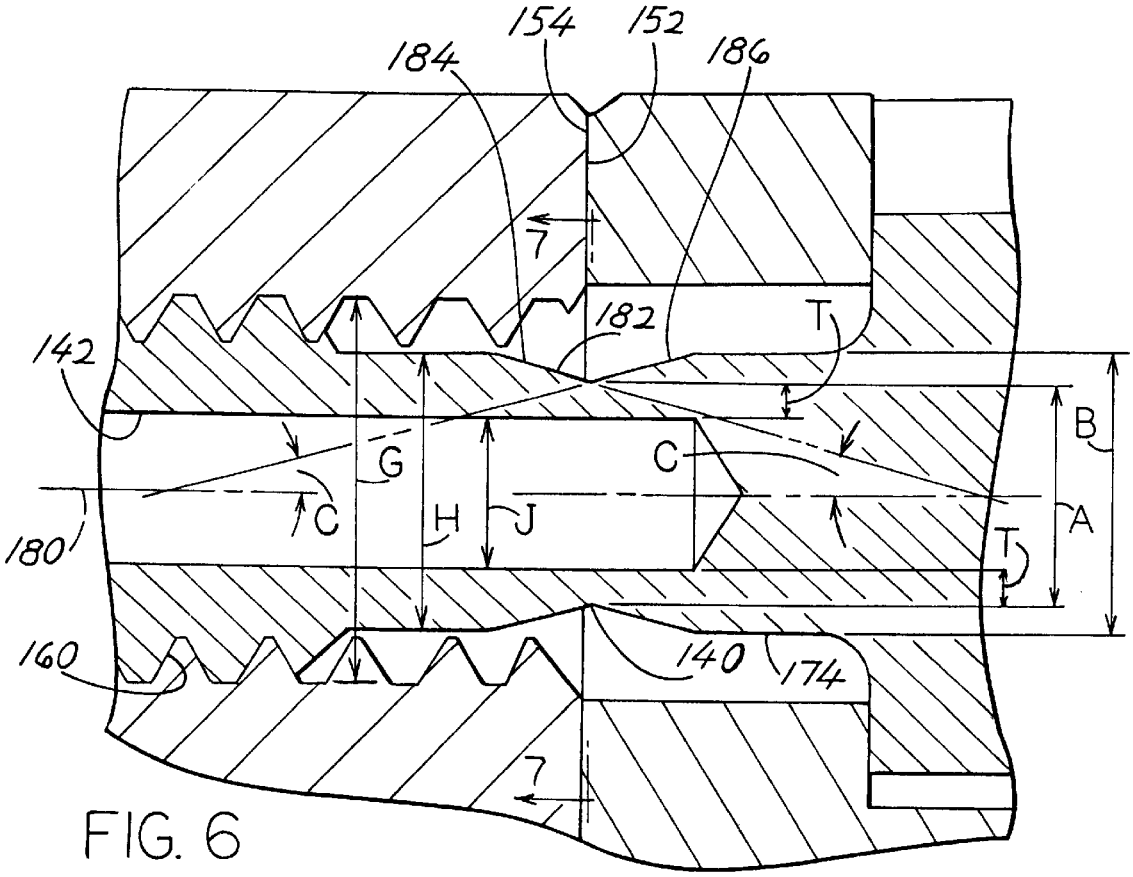
FIG. 6

FIG. 7
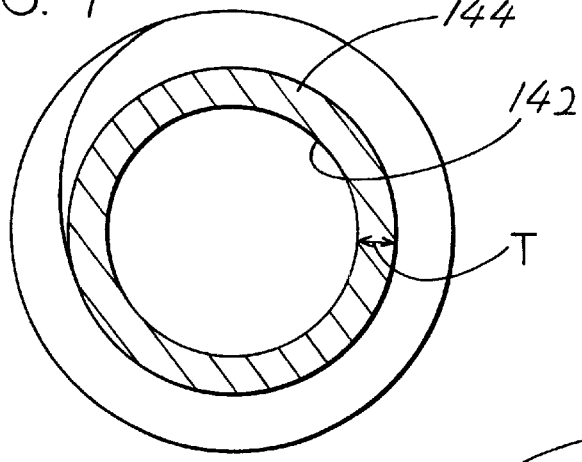
FIG. 9
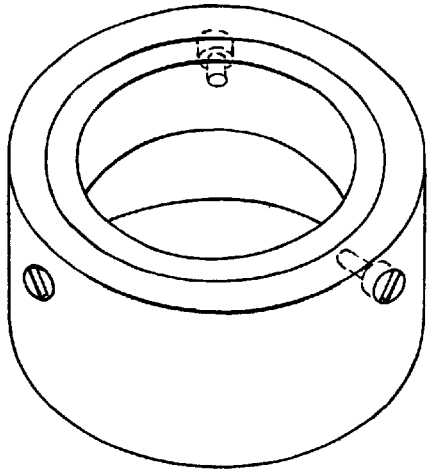
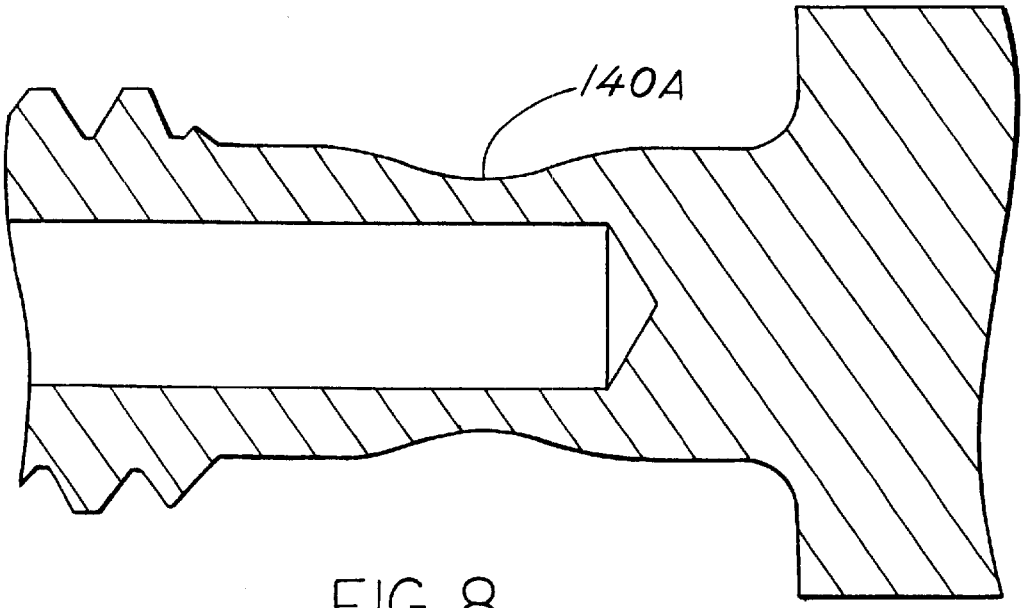
FIG. 8

BREAK-AWAY DEVICE

BACKGROUND OF THE INVENTION

Connectors are often used to connect a cable held on a vehicle such as a truck, to circuitry that does not move with the truck, such as a circuit on a stationary facility. Occasionally, the vehicle is accidently driven away while the connectors are fully mated, resulting in breakage at some weakest location and possible damage due to overstress at other locations. The parts that are broken apart or damaged may be located where there is large cost and delay in repair. A break-away apparatus that resulted in a break at a location that could be repaired at minimal cost and with little downtime for the equipment, would be of value.

SUMMARY OF THE INVENTION

In accordance with one embodiment of the present invention, a break-away apparatus is provided for electrical and optical connectors, which enables separation of two particular connector fittings when a cable is pulled with a high force. The apparatus includes a plurality of break-away fasteners that each extends through a pair of aligned holes at the peripheries of the two fittings. Each fastener includes a shank with a front end connected to the front fitting as by a threaded connection. Each fastener also includes a rear end connected to the rear fitting, as by a screw head that lies against a shoulder on the rear fitting. Each fastener also includes a middle with a groove where the middle has a minimum outside diameter. In addition, a bore extends along the axis of the shank and lies within the middle, to leave a middle portion of ring-shaped cross-section, where the fastener does not engage either fitting and is most likely to break. The ring-shaped cross-section allows the fastener to be firmly screwed in place, and yet produces break-away of the fastener when a predetermined tensile and/or shear force is applied.

The novel features of the invention are set forth with particularity in the appended claims. The invention will be best understood from the following description when read in conjunction with the accompanying drawings.

BRIEF DESCRIPTION OF THE DRAWINGS

FIG. 5 is an enlarged view of a portion of FIG. 3, taken parallel to a breakaway fastener axis.

FIG. 6 is an enlarged view of a portion of FIG. 5.

FIG. 7 is a sectional view taken on line 7—7 of FIG. 6.

FIG. 8 is a sectional view of a portion of a break-away fastener of another embodiment of the invention, taken along the axis of the fastener.

FIG. 9 is a partial isometric view of a pair of fittings of another embodiment of the invention.

DESCRIPTION OF THE PREFERRED EMBODIMENTS

Figure 1:
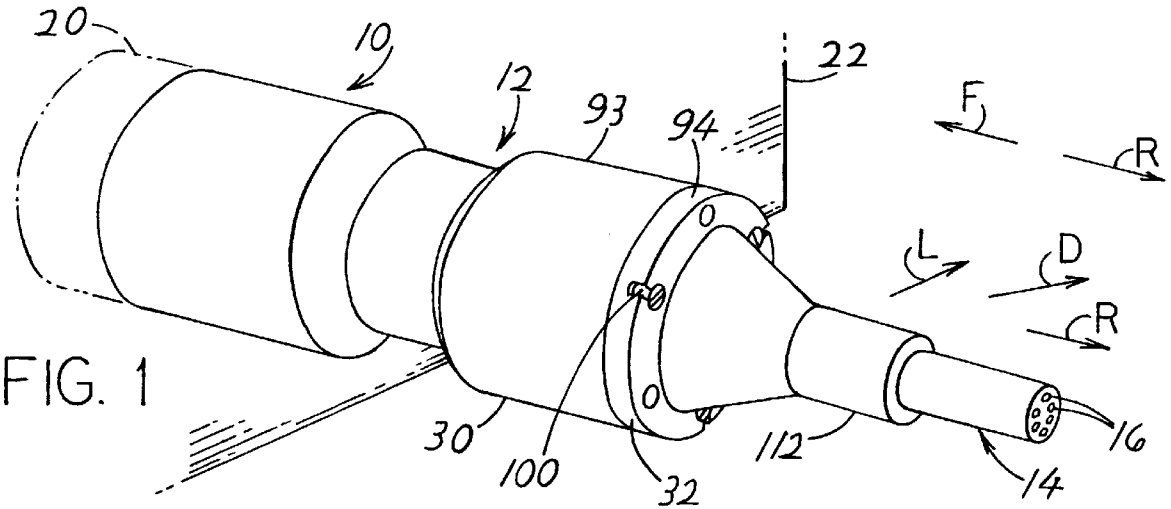
FIG. 1 is a rear isometric view of a connector apparatus of the present invention.

FIG. 1 is an isometric view of a break-away apparatus 10 which includes a connector 12 and a cable 14 that extends rearwardly R from the connector and that has a plurality of conductors 16. In the particular apparatus 10, the connector is an optical fiber connector and the cable conductors 16 carry ("conduct") light. The same construction can be used for an electrical connector where the cable conductors are electrically conductive and carry currents. The connector 12 connects to a mating connector device 20 that is mounted on a fixed facility 22. In one application, the cable 14 leads to circuitry in a vehicle having circuits therein that communicate with corresponding circuits in the fixed facility 22. Once in while, a driver who has connected the two connectors 12, 20 together, drives off without disconnecting them. The cable withstands a high tension force, and the assembly breaks wherever it is weakest, often with some damage to other portions that have been deformed but not broken.

The break-away apparatus 10 is designed to cause separation between front and rear fittings 30, 32 and to break individual conductors 16 when the cable 14 is pulled with a high force. This prevents breakage at unpredictable more forward locations. Breakage at more forward locations can result in large expense and long downtime during which the facility cannot be used.

Figure 2:
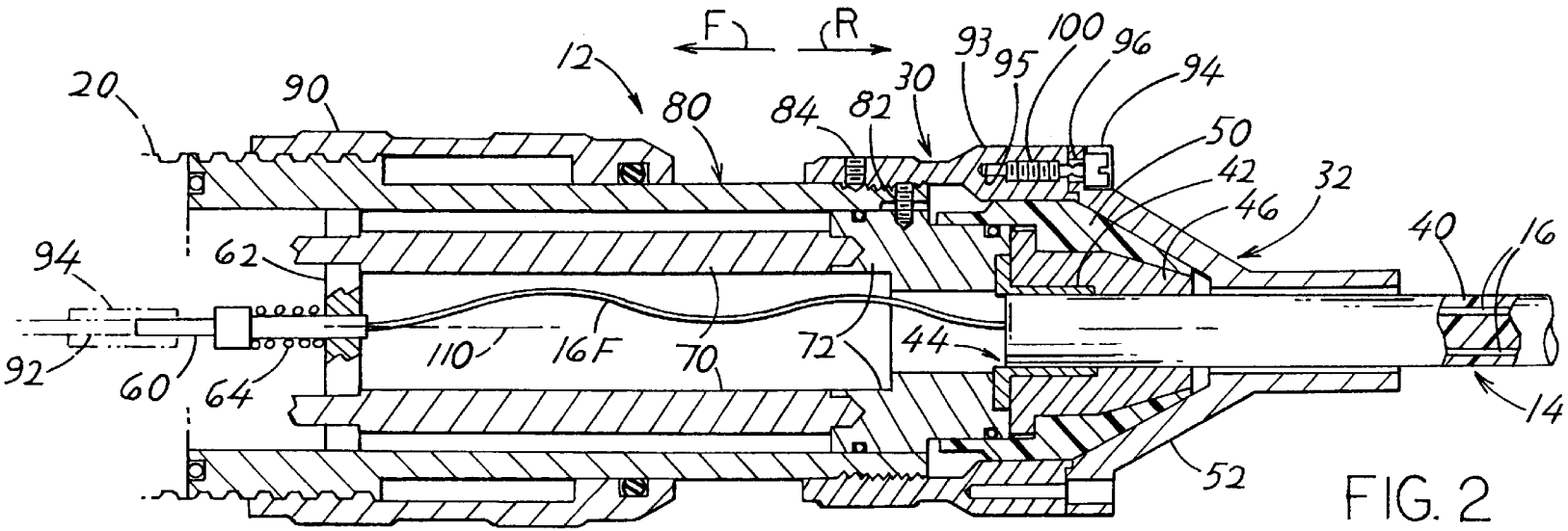
FIG. 2 is a sectional view of the apparatus of FIG. 1.

FIG. 2 shows some details of the connector 12. The cable 14 has an outer part 40 which includes a tough jacket and a filler that separates the conductor 16. A crimp element 42 is crimped to the outer part 40 of the cable. The crimp element is part of an inner clamp device 44 that also includes an inner clamp member 46 that abuts the crimp element 42 to prevent it from moving rearwardly R. An outer clamp member 50 prevents rearward movement of the inner clamp member 46. The rear fitting 32 has a tapered part 52 that backs up the outer clamp member 50. In this way, when the cable 14 is pulled rearwardly with a high force, that force is transmitted to the rearward fitting 32.

The cable has eight conductors 16, each with a front portion 16F, with one of the conductors being shown extending through much of the length of the connector to a ferrule assembly 60. The ferrule assembly can slide within a plate 62 and is biased forwardly by a spring 64. The plate 62 is supported by a plurality of compression members 70, 72 which are connected by set screws 82 to a housing shell 80. The front fitting 30 is fixed by set screws 84 to the housing shell. When the connector 12 is mated to the mating connector device 20, a coupling nut 90 is screwed over threads of the mating device 20, while the ferrule assemblies 60, 92 move against each other within an alignment sleeve 92.

The front and rear fittings 30, 32 have peripheral portions 93, 94 with aligned holes 95, 96. A plurality of break-away fasteners 100 extend through pairs of the aligned holes to hold the two fittings together. When the cable 14 is pulled rearwardly with a high force, on the order of magnitude of 100 pounds, the break-away fasteners 100 break and the fittings separate, with the rear fitting 32 moving rearwardly with the cable 14. Such movement continues until the free portions 16F of the conductors are tensioned and break. Such breakage of the conductors may happen one at a time, although two or more conductors may stretched simultaneously and break together. The bare conductors 16F form the weakest connection between the cable and the ferrule assembly 60 so breakage will occur at conductor portions 16F.

Figure 3:
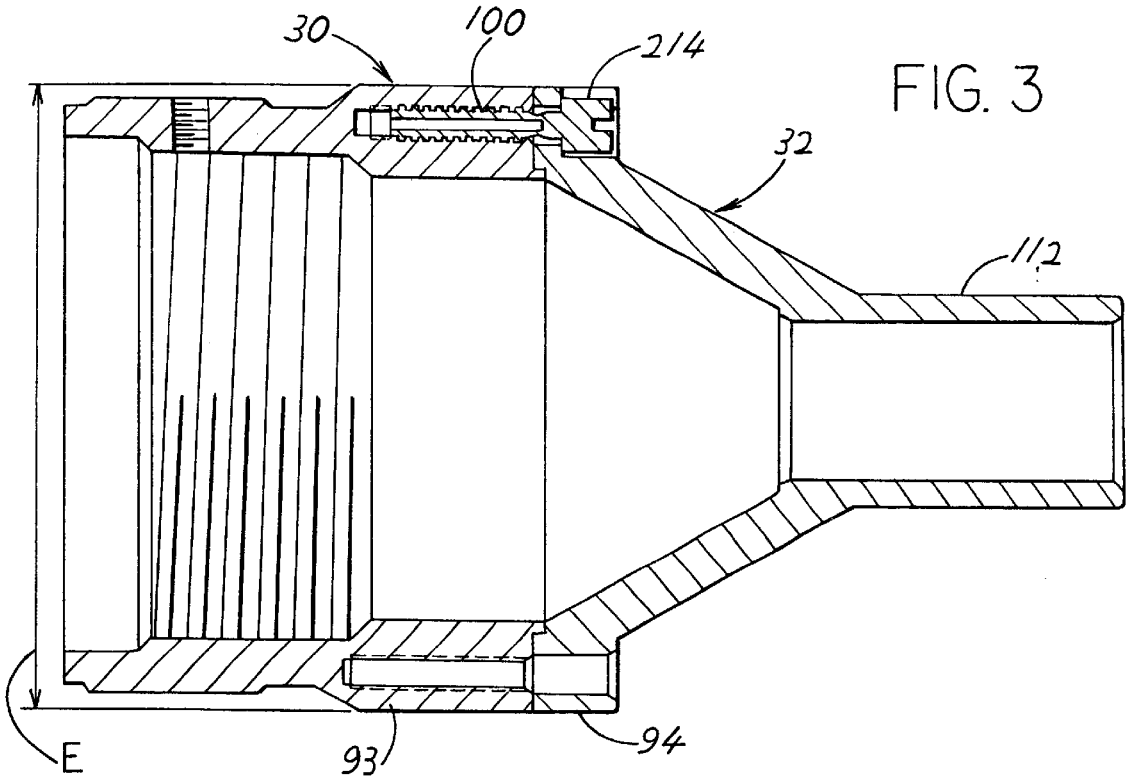
FIG. 3 is an enlarged view of the rear fitting and of one of the break-away fasteners of the apparatus of FIG. 2.
Figure 4:
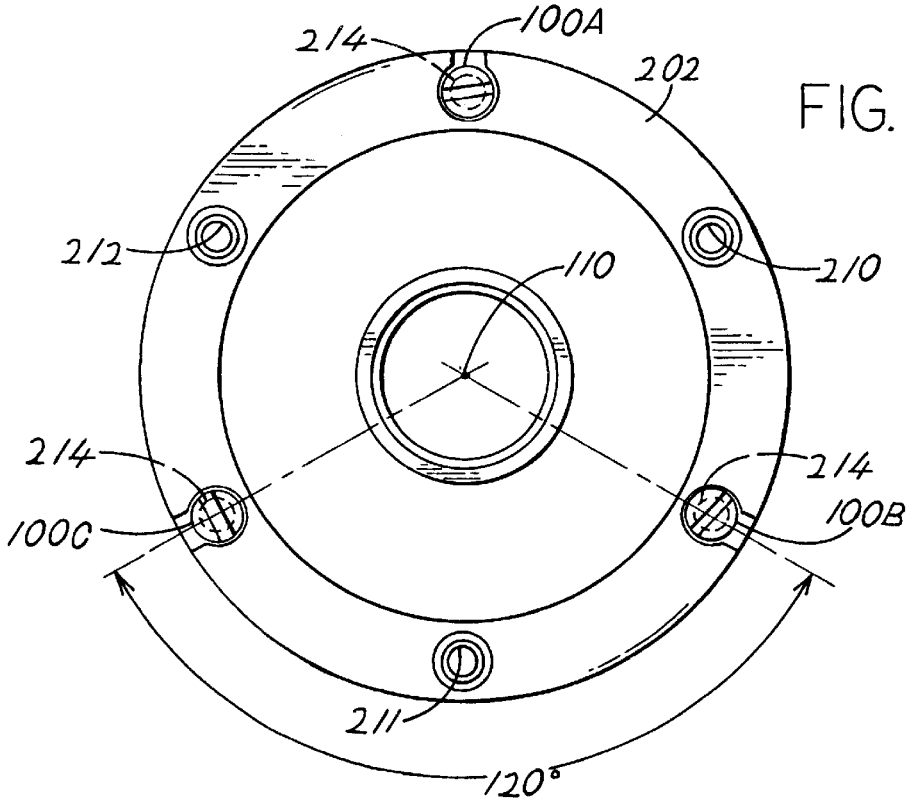
FIG. 4 is a rear elevation view of the apparatus of FIG. 3.

FIG. 3 shows some details of the fittings 30, 32 and of one of the break-away fasteners 100 that connect them. FIG. 4 shows that in the final assembly, there are three breakaway fasteners 100A, 100B, 10C that are spaced 120° about an axis 110 of the connector. As indicated in FIG. 1, the cable 14 may be pulled rearwardly R, in any sideward or lateral direction L which is perpendicular to the rearward direction, or in a direction D which is in-between these two directions. When the cable is pulled rearwardly, the fasteners 100 are under tension force. When the cable is pulled in other directions, there is shear force, although the considerable length of a tubular rear end 112 of the rear fitting results in largely tension forces.

FIGS. 5 and 6 show details of one of the break-away fasteners 100. Each fastener includes a shank 120 with front and rear end portions 122, 124 and a screw head 126 lying at the rear end of the shank rear end portion. The shank front end portion has an external thread 130. Each shank rear portion 124 has a break-away location 140 of small outside diameter A, The outside diameter B of the shank forward and rearward of the break-away location 140 is greater than at the break-away location. A bore 142 extends at least partially through the shank, and lies within the break-away location 140. As shown in FIG. 7, this results in a ring-shaped cross-section at 144, which has the smallest cross-section along the fastener between the rear end of the threaded portion and the front end of the head.

It would be possible to not have a bore, but instead provide a groove with a small diameter at the break-away location, with the diameter resulting in a cross-section that is about the same as the ring-shaped cross-section 144 of FIG. 7. However, this would make it difficult to turn the fastener so as to screw it into the threaded hole in the front fitting without damaging the fasteners. The ring-shaped cross-section results in the fastener middle being able to transmit torque to its threaded front end portion when the head is turned to tighten the screw, while assuring that the fastener will break when a moderate tension or shear force is applied to it.

FIG. 5 shows that the hole 95 in the front fitting is threaded from its rear surface 152 to the front end of the fastener. The rear fitting has a surface 154 that abuts the front fitting surface 152, although a seal sheet can lie between them. When the screw fastener is screwed into place, this results in screw shoulders 160 at the rear end of each external thread on the shank abutting internal thread shoulders 162 formed in the threaded hole of the fitting. At the rear end of the screw, a forwardly-facing shoulder 170 on the screw head abuts a rearwardly-facing shoulder 172 on the rear fitting. The abutting shoulders result in the middle 174 of the fastener, along the shank rear end portion 124, being not directly supported by either fitting, so it can break at the break-away location 140.

It is noted that the break-away location 140 lies at the "bottom" or radially innermost location of a groove 182, with respect to the fastener axis 180. The groove 182 has front and rear ends 184, 186 which are each angled by an angle C of about 15° from the direction of the axis 180, with the angles C preferably being no more than 30°. A greater angle will result in a greater discontinuity at the bottom of the groove, at the break-away location 140, resulting in less reliable break-away. FIG. 8 shows another embodiment of the invention, where the groove 190 is of sine wave shape, resulting in the groove walls being inclined at nearly zero degrees at the bottom 140A of the groove.

FIGS. 3 and 4 show that the peripheries 93, 94 of the front and rear fittings 30, 32, where the fastener-receiving holes lie, have six pairs of holes. Three pairs of holes 210–212 do not contain a fastener, while the other three pairs of holes 214 each contain a break-away fastener. When the connector is assembled, applicant initially installs three ordinary screws in the holes 210–212 to hold the fittings together and assure that adjacent surfaces of the fittings firmly abut one another (it is possible to provide a seal between them). The screws in the holes 210–212 can be tightened firmly with a torque that might damage the break-away fasteners. When the three screws in holes 210–212 have been tightened, the break-away fasteners 100 are inserted in the three other pairs of holes 214 and turned with a small final torque. The torque is light enough that it does not damage the break-away fasteners, it already being assured that the fittings have been well seated against one another. After the ordinary fasteners are installed in holes 210–212, the ordinary screw fasteners are removed from the holes.

Applicant has built and tested a break-away connector and break-away fastener of the type shown in FIGS. 1–7. The fittings shown in FIG. 3 have an outside diameter E of 1.9 inch. Each of the fasteners 100 is similar to a type 440 screw, with the thread having an outside diameter G (FIG. 6) of 0.08 inch and the bore having a diameter J of 0.044 inch. In one fastener, with groove ends extending at an angle C of 15° to the axis, the bottom of the groove has an outside diameter A of 0.054 inch, resulting in the ring at the break-away location having a ring thickness T of 0.005 inch. When the fastener was formed of an aluminum alloy (6061-T6) the screw broke when subjected to a tension of 25 pounds. When the fastener was formed of stainless steel (type 303) and the ring thickness T was 0.004 inch, the screw broke at a tension force of about 50 pounds. The individual conductors at 16F, each consisting of an optical fiber within a thin sheath having an outside diameter of 0.033 inch, breaks before any serious damage is caused to other parts, and especially before any damage is caused to the mating connector device 20. If a large force is applied to the cable before break-away, the inner clamp device 44, outer clamp device 50 and fitting tapered part 52 will be highly stress, resulting in damage. The damage is isolated by forming the outer clamp element 50 of plastic which will break before other parts such as 46 or 52. The plastic part is of low cost compared to the metal machined parts 46, 52.

Thus, the invention provides a break-away apparatus for electrical and optical connectors, which results in breaking of fasteners to separate two known parts of the connector when a predetermined force is applied to the rear of the connector, such as through a cable. Front and rear fittings are provided that have peripheral portions that substantially abut one another and that have aligned holes, with break-away fasteners lying in each of a plurality of the pairs of holes. Each fastener can include a screw with a threaded front end that is anchored in the front fitting (directly or through a threaded nut), a head at its rear end that firmly abuts the rear fitting, and a middle with a groove that weakens the middle to allow it to break away. The middle is not directly fixed to either fitting so when it beaks the fittings can move apart. The screw has a bore that extends to within the middle, so the middle has a ring-shaped cross-section. This allows the screw to withstand torque during tightening, but the screw has low tension and shear strength to break-away at a relatively low tension and/or shear force. A cable is clamped or otherwise fixed to the rear fitting, while the front ends of thin conductors of the cable extend to a connector part that is coupled to the front fitting, so when the rear fitting moves rearwardly, the thin conductors are broken to minimize damage.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A breakaway connector that can hold a front end portion of a cable, where the cable include an outer part and at least one elongated conductor that lies within said outer part and that has a front end that extends forward of said outer part and that has a lower tensile strength than said cable at said cable outer part, comprising:

a rear cable clamp assembly that clamps to said outer part of said cable front end portion to move rearward with said outer part of said cable when said cable is pulled with a large force, said clamp assembly including a connector rear fitting with a center hole through which said cable extends, said rear fitting having a plurality of fastener-receiving holes spaced about said center hole;

a front assembly that includes a front fitting, said front assembly being mechanically connected to said cable conductor front end to hold said cable conductor front end when said cable is pulled with a large force, said forward fitting having a plurality of fastener-receiving holes that are aligned with said fastener-receiving holes in said rear fitting;

a plurality of breakaway fasteners that each extends through a pair of aligned fastener-receiving holes in said rear and front fittings, said fasteners being spaced about said center hole, and each of said fasteners being constructed to break when a large force is applied to it as a result of said cable being pulled with a large force.

2. The connector described in claim 1 wherein:

each of said breakaway fasteners has a shank, said shank having an axis, a groove extending around axis, and a bore that extends along said axis to a position within said groove, to leave a thin wall of ring-shaped cross-section that breaks in tension when a predetermined tensile force is applied between opposite ends of said fastener.

3. The connector described in claim 1 wherein:

each of said breakaway fasteners includes a shank with an axis and with opposite end portions and a wrench-turnable head at a first of said end portions, the second of said end portions being threaded;

said shank of each fastener having a groove lying between said threaded second end portion and said head;

each of said fasteners has a bore that extends along said axis with a portion of said bore lying within said groove;

the fastener-receiving holes of a first of said fittings bring threaded and the second of said fittings having a shoulder facing away from said first fitting and lying around each of said fastener-receiving holes therein;

each of said fasteners has its threaded second end portion lying in and threadably engaged with one of said holes of said first fitting, and has a head lying against a shoulder of said second fitting.

4. The connector described in claim 1 wherein:

said rearward and forward fittings each have a plurality of extra pairs of aligned holes, to thereby allow assembly with temporary screws which are removed when said breakaway fasteners are installed.

5. Breakaway apparatus for electrical and optical connectors that connect to a cable that has a cable outer part and at least one elongated conductor that lies within the cable outer part, wherein the conductor has a front end that extends forward of said cable outer part and that has a lower tensile strength than locations at said cable outer part, comprising:

front and rear connector fittings that lie substantially facewise against each other, that have a plurality of pairs of aligned fastener-receiving holes, and that each forms a fastener-engaging shoulder at each hole that faces largely away from the other fitting;

a plurality of fasteners that each extends at least partially through one of said pairs of aligned holes, each fastener having front and rear fastener end portions with fastener shoulders that respectively engage one of said fastener-engaging shoulders to prevent separation of said fittings;

each of said fasteners including a middle lying between the front and rear end portions and forming a breakaway location, and each of said fasteners has a bore that lies within said breakaway location to leave a ring-shaped cross-section at the breakaway location;

a rear cable clamp assembly that includes said rear fitting and that clamps to said outer part of said cable to move rearward with said outer part of said cable when said cable is pulled with a large force;

a front assembly that includes said front fitting and that connects to said front end of said at least one elongated conductor, said front assembly being fixed to said rear assembly substantially only at said front and rear fittings, so that when said cable is pulled with sufficient force to break said fasteners, said fittings separate and said at least one conductor breaks.

6. The connector described in claim 5 wherein:

said rear cable clamp assembly includes inner and outer tapered sleeves lying nested one within the other, said rear fitting having a tapered internal surface and said at least two tapered sleeves are nested within said rear fitting tapered surface;

said rear fitting and said inner tapered sleeve are each formed of metal and said outer sleeve is formed of plastic that is weaker than the metals of said rearward fitting and said inner sleeve, whereby only said plastic outer sleeve is broken when said cable is pulled with a high force.

7. Breakaway apparatus for electrical and optical connectors comprising:

front and rear connector fittings that have aligned axes and that lie substantially facewise against each other, said fittings having a plurality of pairs of aligned fastener-receiving holes spaced about said axes, and each fitting forms a fastener-engaging shoulder at each hole that faces largely away from the other fitting;

a plurality of breakaway fasteners that each extends at least partially through one of said pairs of aligned holes, each fastener having front and rear fastener end portions with fastener shoulders that respectively engage one of said fastener-engaging shoulders to prevent separation of said fittings;

each of said fasteners including a middle lying between the front and rear end portions and forming a breakaway location, and each of said fasteners has a bore that lies within said breakaway location to leave a ring-shaped cross-section at the breakaway location;

said fittings have at least three pairs of said holes that are spaced about said axes with one of said breakaway fasteners in each of said pairs of holes, and said fitting have a plurality of pairs of said holes for receiving temporary nonbreakaway screws but with nonbreakaway screws not lying in said holes.

* * * * *